US005383508A

United States Patent [19]

Pavlica et al.

[11] Patent Number: 5,383,508

[45] Date of Patent: Jan. 24, 1995

[54] VALANCE STRUCTURE

[76] Inventors: Pamela C. Pavlica, 3218 Mount Diablo St., Concord, Calif. 94518; William W. Schirmer, 273 Gladys Dr., Pleasant Hill, Calif. 94523

[21] Appl. No.: 77,027

[22] Filed: Jun. 15, 1993

[51] Int. Cl.[6] ..... E06B 9/00

[52] U.S. Cl. ..... 160/38

[58] Field of Search ..... 160/38, 39, 19, 21

[56] References Cited

U.S. PATENT DOCUMENTS

| | | | |
|---|---|---|---|
| 224,466 | 2/1880 | Murphey | 160/39 |
| 1,952,069 | 3/1934 | Hoffheimer et al. | 160/39 |
| 2,448,061 | 8/1948 | Stenz . | |
| 2,513,628 | 7/1950 | Eaglin | 160/39 |
| 2,664,946 | 1/1954 | Kravitz . | |
| 3,435,876 | 4/1969 | Toti | 160/38 |
| 4,662,421 | 5/1987 | Basmadji et al. | 160/38 |
| 4,828,002 | 5/1989 | Ashby | 160/21 X |
| 4,955,419 | 9/1990 | Morris . | |
| 5,039,049 | 8/1991 | Niemi . | |
| 5,042,548 | 8/1991 | Attal | 160/21 X |

*Primary Examiner*—David M. Purol

*Attorney, Agent, or Firm*—Schapp and Hatch

[57] ABSTRACT

A valance structure employing interchangeable facades or placards of a predetermined size utilizing a top portion which is mounted on a surface. The top portion possesses a flange and a groove on the flange of a certain depth. A bottom portion is also employed with the top portion. The bottom portion includes a second flange having a groove of a depth which is smaller than the depth of the groove of the top portion first flange. A spacer is employed for positioning the top and bottom portions apart. The floors of the grooves are separated a certain distance to permit interchangeable placards replaced in the top and bottom portion grooves.

3 Claims, 1 Drawing Sheet

VALANCE STRUCTURE

BACKGROUND OF THE INVENTION

The present invention relates to a novel and useful valance structure employing interchangeable placards or inserts.

Interior windows and doors are often trimmed at the top portion by a valance. Valance may take the form of a wooden body or be composed of softer material such as cloth, paper, plastic, and the like. Most prior art valance structures have been permanently placed on a surface such as a wall requiring removal and replacement when a room within a building is redecorated.

U.S. Pat. Nos. 4,955,419 and 5,039,049 depict valance structures having removable valances that overlie base members relatively permanently fixed to the surface. U.S. Pat. No. 2,664,946 depicts an adjustable cornice having a frame like portion permitting an insert to be slipped downwardly into the same for design purposes. U.S. Pat. No. 2,448,061 teaches a valance having an insertable portion that slides into a vertical slot and is, presumptively, removable from the same.

A valance structure which permits interchangeable placards to be used with ease and efficiency would be a notable advance in the home decorating field.

SUMMARY OF THE INVENTION

In accordance with the present invention a novel and useful valance structure is herein provided.

The valance structure of the present invention employs interchangeable placards or inserts which normally have a particular design or pattern commensurate with the decor of the room. The structure includes a top portion having a flange. The flange includes a top groove of a certain depth terminating in a floor. The top portion is fixed to a surface such as a wall. An external molding or facia may also be included in the top portion visible to persons in the room.

A bottom portion is also defined in the present invention and possesses a second flange. The second flange includes a second groove of a certain depth which is smaller than the depth of the first groove of the top portion.

Spacer means is also provided in the present invention for positioning the top portion first flange relative to the bottom portion second flange, such that the floor of the first and second grooves are a certain distance apart. This distance would correspond to the height of a placard to be supported within the top and bottom portion grooves. The spacer means may include a backing member connected to the first and second flanges. This construction permits the first and second flanges to extend outwardly from the backing member. In addition, each of the first and second flanges may include facias that are visible to the user of the valance structure. Moreover, the backing member from the top and bottom portions may be constructed as a unit and be placed above a window or door. In this manner, the unit is some what permanently fixed to a surface while the placard fitting in the groove structure would be freely interchangeable to suit the particular decor of the room.

It may be apparent that a novel and useful valance structure has been described.

It is therefore an object of the present invention to provide a valance structure which utilizes interchangeable portions, as well as inserts or placards which correspond to the particular decor of a room.

There is another object of the present invention to provide a valance structure having interchangeable placards or inserts which are easily and freely placed in a groove structure provided by top and bottom portions of the valance structure.

Another object of the present invention is to provide a valance structure which is easy to manufacture and repair.

The invention possesses other objects and advantages especially as concerns particular characteristics in features thereof which will be apparent as the specification continues.

Figure 1:
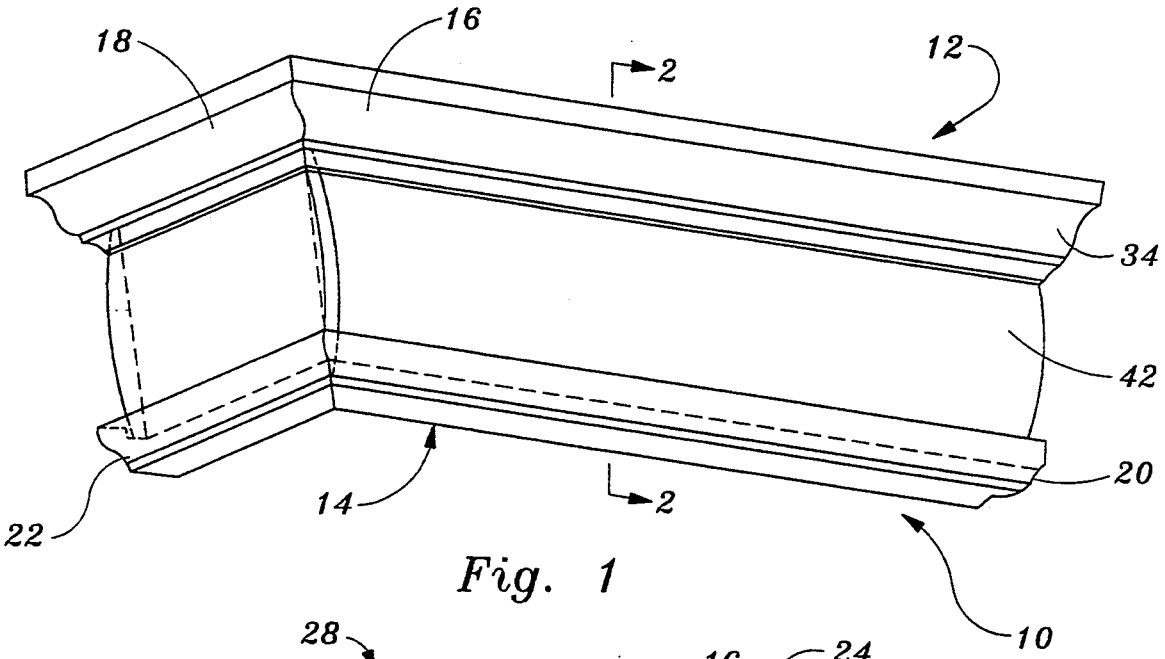
FIG. 1 is a bottom left perspective view of the valance structure of the present invention.

For a better understanding of the invention references made to the following detailed description of the preferred embodiments thereof which will be taken in conjunction with the herein above described drawings.

DETAILED DESCRIPTION OF THE PREFERRED EMBODIMENTS

Various aspects of the present invention will evolve from the following detailed description of the preferred embodiments thereof which should be referenced to the prior described drawings.

The invention as a whole is depicted in the drawings by reference character 10. The valance structure 10 includes as one of its elements a top portion 12 and a bottom 14. Top portion 12 is split into two sections 16 and 18 which are generally at right angles to one another. Likewise, bottom portion 14 takes the form of two sections 20 and 22 similarly constructed.

Figure 2:
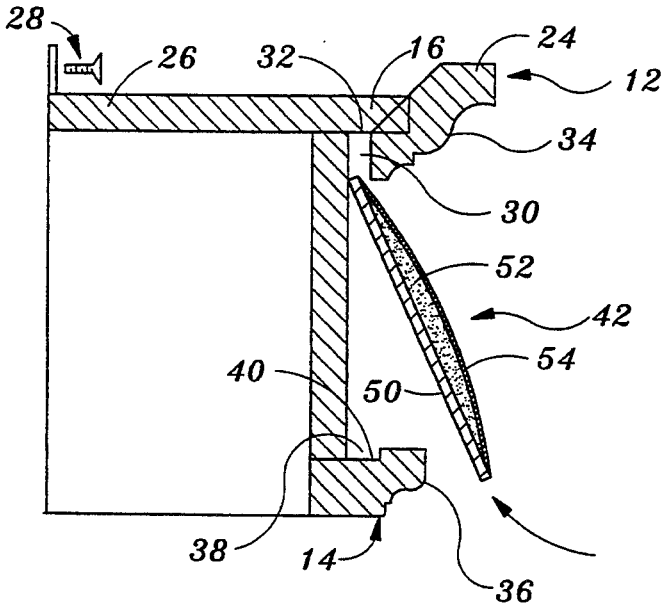
FIG. 2 is a sectional view taken along line 2—2 of FIG. 1.
Figure 3:
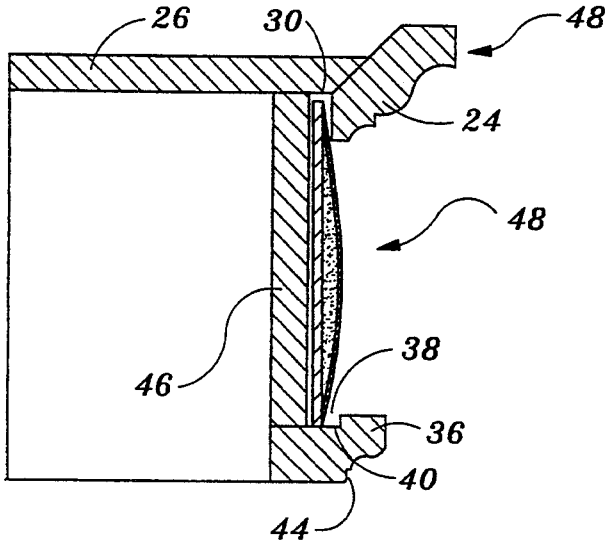
FIG. 3 is sectional view similar to FIG. 2 depicting a placard or insert in place within the groove configuration provided by the valance structure of the present invention.

With reference to FIG. 2, it may be seen that top portion 12 includes a flange 24 which extends from a top surface member 26, which may function as a dust cover. Fastener 28 attaches top portion 12 to a surface such as a wall. Fastener 28 may take the form of a screw, bolt, mastic, and the like. Top portion 12 is formed with a first groove 30 having a floor 32. Surface 34 of a portion 12 includes a facia or design which is visible to viewers of valance structure 10.

Bottom portion 14 is also formed with a flange 36. Flange 36 includes a second groove 38 possessing a floor 40. It should be noted that first groove 30 has a depth larger than second groove 38. It has been found that this disparity in the depth of grooves 30 and 38 permits an insert or placard such as placard 42 to be removably placed in grooves 30 and 38 and maintain stable vertical orientation therewithin. Facia portion 44 serves the same purpose as facia portion 34 with respect to top portion 12.

Backing member 46 is also included in the present invention serves as spacer means 48 for positioning top portion flange 24 relative to bottom portion flange 36. In this way, floor 32 of groove 30 is also spaced a predetermined distance from floor 40 of groove 38. This distance is maintained along grooves 30 and 38 to permit the interchangeability of placards such as 42. Backing member 46 is connected to top surface member 26 to form a unit 48 which is fixed to a surface by fastener 28. Top and bottom portions 12 and 14 may be replaced in unit 48 by elements having grooves similar to grooves 30 and 38, and facias different from surfaces 34 and 44.

In operation, the valance structure of the present invention is mounted above a window or door by the use of fastening means such as fastener 28. Placards such as placards 42 are then interchangeably placed within grooves 30 and 38 commensurate with the decor of the room in which valance structure 10 is mounted. Placard 42 is depicted as having a rigid base 50, filler portion 52 and external surface 54 which carries particular design. To insert placard 42, the user slips the same into groove 30 initially and then the remainder into groove 38. Removal of placard 42 is achieved by reversing the above process. Thus, a system of which employs interchangeable placards is provided by valance structure 10, obviating the need to replace the valance structure each time the decor of the room is changed.

While in the foregoing embodiments of the invention have been set forth in considerable detail for the purposes of making a complete disclosure of the invention, it may be apparent to those of ordinary skills in the art that numerous changes may be made in such details without departing from the spirit and principles of the invention.

What is claimed is:

1. A valence structure, comprising:

an upper portion defining an upper channel which opens downwardly when said valence structure is mounted in its operative position adjacent the upper edge of a window, said upper channel being comprised of a major segment which is substantially parallel to the wall containing said window and at least one minor segment which extends toward said wall from said major segment;

a lower portion defining a lower channel which opens upwardly when said valence structure is mounted in its operative position adjacent the upper edge of a window, said lower channel being comprised of a major segment which is substantially parallel to the wall containing said window and at least one minor segment which extends toward said wall from said major segment and is of lesser depth than said upper channel;

an intermediate portion which maintains said upper portion and said lower portion in predetermined juxtaposition wherein each segment of said lower channel confronts a corresponding segment of said upper channel; and a carrier for carrying decorative material comprising a first substantially rigid panel and at least one other substantially rigid panel hingedly attached thereto;

said carrier being emplaceable in said upper and lower channels by manually positioning said at least one other panel with respect to said first panel at an angle substantially equal to the angle between said major channel segments and said minor channel segments, thrusting the upper edge of said first panel into said major segment of said upper channel, rotating said carrier about said major segment of said upper channel until the lower edge of said first panel overlies said major segment of said lower channel and said at least one other panel overlies said at least one minor segment of said lower channel, and allowing the lower edges of said panels to drop into their corresponding segments of said lower channel without becoming disengaged from their corresponding segments of said upper channel.

2. A valance structure as claimed in claim 1 in which said carrier is emplaceable in said upper and lower channels with either major face of said first panel facing outwardly from said wall.

3. A valance structure as claimed in claim 2 in which said carrier is comprised of said first panel and two other panels hingedly attached to its opposite ends.

* * * * *